US006179442B1

(12) United States Patent
Schurle

(10) Patent No.: US 6,179,442 B1
(45) Date of Patent: Jan. 30, 2001

(54) CHRISTMAS STAR LIGHT DEVICE

(75) Inventor: Stan Schurle, Manhattan, KS (US)

(73) Assignee: S & S Stars, LLC, Manhattan, KS (US)

( * ) Notice: Under 35 U.S.C. 154(b), the term of this patent shall be extended for 0 days.

(21) Appl. No.: 09/400,008

(22) Filed: Sep. 20, 1999

Related U.S. Application Data

(60) Provisional application No. 60/101,385, filed on Sep. 21, 1998.

(51) Int. Cl.[7] ..... F21W 121/00
(52) U.S. Cl. ..... 362/252; 362/121; 362/807
(58) Field of Search ..... 362/121, 252, 362/807, 249, 806

(56) References Cited

U.S. PATENT DOCUMENTS

| | | | | |
|---|---|---|---|---|
| 2,722,317 | | 11/1955 | Goodwin | 211/89 |
| 2,894,345 | | 7/1959 | Bushnell | 41/10 |
| 3,184,366 | | 5/1965 | Claude | 161/14 |
| 3,704,367 | | 11/1972 | Korb | 240/105 |
| 4,523,260 | | 6/1985 | Duncan | 362/121 |
| 4,769,749 | | 9/1988 | Felski | 362/250 |
| 5,077,646 | | 12/1991 | Parsons | 362/252 |
| 5,213,409 | | 5/1993 | Fisher | 362/252 |
| 5,430,626 | | 7/1995 | Leffel | 362/121 |
| 5,526,246 | * | 6/1996 | Liou | 362/252 |
| 5,712,770 | | 1/1998 | Huang | 362/252 |
| 6,017,134 | * | 1/2000 | Wang | 362/252 |
| 6,019,494 | * | 2/2000 | Lee | 362/807 |
| 6,027,228 | * | 2/2000 | Adams et al. | 362/252 |
| 6,068,389 | * | 5/2000 | Lai | 362/252 X |

* cited by examiner

*Primary Examiner*—Laura K. Tso
(74) *Attorney, Agent, or Firm*—Flanagan & Flanagan; John K. Flanagan; John R. Flanagan

(57) ABSTRACT

A Christmas star light device includes sets of first and second elongated members. Each first elongated member has a straight portion terminating at a first end of the first elongated member with the first end having a first cross-sectional size, an angled portion merging from the straight portion and terminating at a second end of the first elongated member with the second end having a second cross-sectional size greater than the first cross-sectional size, and slots defined on and spaced apart along the first elongated member between the opposite ends thereof for receiving and mounting light elements on the first elongated member. Each second elongated member has a straight portion terminating at a first end of the second elongated member with the first end having the first cross-sectional size, an angled portion merging from the straight portion and terminating at a second end of the second elongated member and with the second end having the second cross-sectional size, and slots defined on and spaced apart along the second elongated member between the opposite ends thereof for receiving and mounting light elements one the second elongated member. The first end of each of the second elongated members is insertable into the second end of one of the first elongated members for releasably interfitting therewith and the first end of each of the first elongated members is insertable into the second end of one of the second elongated members for releasably interfitting therewith such that all of the first and second elongated members fit together in like fashion and form a star without any of the first and second elongated members crossing one another.

20 Claims, 7 Drawing Sheets

50
44C
44E
50
54
68
70
80
76
70
66
44B
48
72
44
72
44F
44F
44D
62
64
52
60
15

50
80
68
72A
72C
72B
72A
76
44E
44
48
72
72
62
44A
52
64
60
15

16
50
44B
44C
44B
66
54
66
44E
44
44F
48
44A
52
16
15

20
46B
70
66
46C
78
58
46
46F
56
46E
46A
64
60
19
20
66
46B
68
82
78
46E
46
74A
74B
74C
74
74A
62
46A
64
60
19
70
46B
68
66
70
82
78
46C
46F
46
74A
74
74C
74B
74A
62
46A
64
60

CHRISTMAS STAR LIGHT DEVICE

This application claims the benefit of provisional application number 60/101,385, filed Sep. 21, 1998.

BACKGROUND OF THE INVENTION

1. Field of the Invention

The present invention generally relates to ornamental lighting devices and, more particularly, is concerned with a Christmas star light device.

2. Description of the Prior Art

Ornamental stars are often employed to celebrate Christmas. Many people display stars on their homes during the Christmas holiday season. It is desirable that stars used for this purpose be large and lighted. These stars are often homemade. Many of these stars, however, are heavy and awkward and, thus, difficult to set up and take down. Also, in daylight, the shapes of these stars are often not discernable and materials used in the construction of the stars may be too visible.

Various ornamental lighting devices, including those which resemble stars, have been developed over the years. Representative examples of ornamental lighting devices and the like are disclosed in U.S. Pat. No. 2,722,317 to Goodwin, U.S. Pat. No. 2,894,345 to Bushnell, U.S. Pat. No. 3,184,366 to Claude, U.S. Pat. No. 3,704,367 to Korb, U.S. Pat. No. 4,523,260 to Duncan, U.S. Pat. No. 4,769,749 to Felski, U.S. Pat. No. 5,077,646 to Parsons, U.S. Pat. No. 5,213,409 to Fisher, U.S. Pat. No. 5,430,626 to Leffel and U.S. Pat. No. 5,712,770 to Huang. The Bushnell patent discloses a star-shaped frame construction which employs frame members which are substantially identical to one another and connected to one another at their ends. The frame members of the Bushnell device interfit with one another, but must cross one another to achieve a star-like configuration. The Duncan patent discloses two types of members which are connected to one another to form a star. The members of the Duncan device, however, do not interfit with one another. The Leffel patent discloses a plurality of arm braces which interfit with one another to form a star. The arm braces of the Leffel patent, however, have a complicated design and are comprised of a multiplicity of parts.

Consequently, a need remains for an ornamental lighting device which overcomes the aforementioned problems in the prior art without introducing any new problems in place thereof.

SUMMARY OF THE INVENTION

The present invention provides a Christmas star light device designed to satisfy the aforementioned need. The Christmas star light device of the present invention has a large size but is comprised of a substantially lightweight material and, thus, is easy for a homeowner to handle. The Christmas star light device includes parts which interfit and do not cross one another and which are simple in design. The Christmas star light device particularly includes two sets of five substantially identical members each or ten separate members which make the device cost-effective to manufacture and easy to assemble, disassemble and store. The Christmas star light device makes it relatively easy for a homeowner to lift the device and place the device on a rooftop or a side of a building such that the device is discernable and more attractive to view even in daylight.

Accordingly, the present invention is directed to a Christmas star light device which comprises: (a) a set of first elongated members each including (i) a pair of opposite ends, (ii) means defined on the first elongated member between the opposite ends thereof for receiving and mounting light elements on the first elongated member; (iii) a straight portion terminating at a first of the opposite ends of the first elongated member having a first cross-sectional size, (iv) an angled portion defining an angle and merging from the straight portion and terminating at a second of the opposite ends of the first elongated member having a second cross-sectional size greater than the first cross-sectional size; and (b) a set of second elongated members each including (i) a pair of opposite ends, (ii) means defined on the second elongated member between the opposite ends thereof for receiving and mounting light elements on the second elongated member, (iii) a straight portion terminating at a first of the opposite ends of the second elongated member having the first cross-sectional size, (iv) an angled portion defining a second angle and merging from the straight portion and terminating at a second of the opposite ends of the second elongated member having the second cross-sectional size such that the first end of each of the second elongated members is insertable into the second end of one of the first elongated members for releasably interfitting therewith and the first end of each of the first elongated members is insertable into the second end of one of the second elongated members for releasably interfitting therewith whereby all of the first and second elongated members fit together in like fashion and form a star without any of the first and second elongated members crossing one another. The straight and angled portions of each of the first and second elongated members and the first ends of the first and second elongated members have the first cross-sectional size.

More particularly, in a first embodiment, each of the first and second elongated members has a tubular configuration whereas in a second embodiment each of the first and second elongated members has a cross-sectionally U-shaped channel configuration. The first angle of the angled portion of each of the first elongated members is an acute angle where as the second angle of the angled portion of each of the second elongated members is an obtuse angle.

Further, the means for receiving light elements are slots defined on and spaced apart from one another along each of the first and second elongated members. Each slot has a central eyelet and opposite elongated portions flanking the central eyelet. The central eyelet is for receiving the light element on a portion of an electrical cord and the opposite elongated portions for receiving the portion of the electrical cord.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
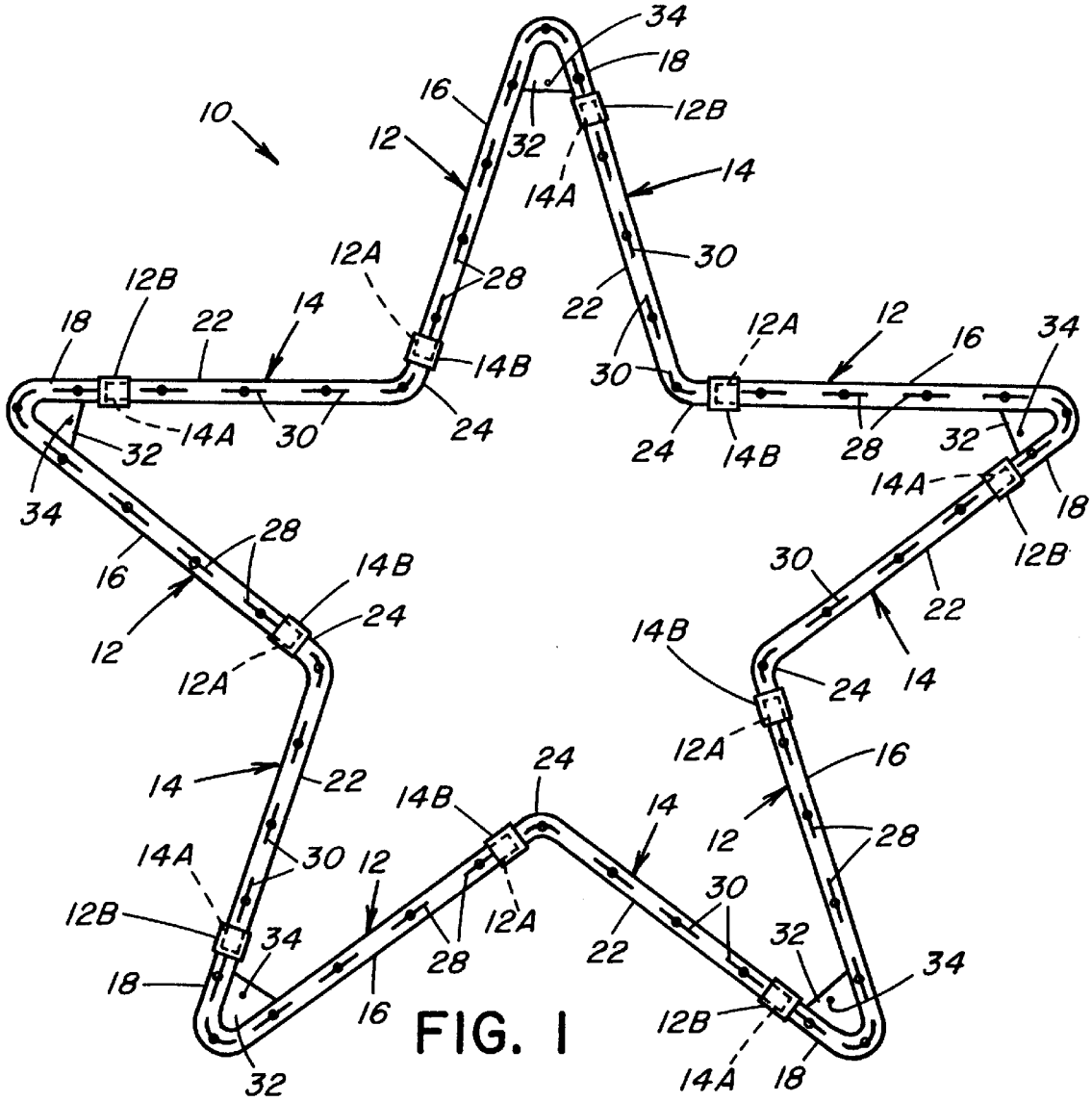
FIG. 1 is a front elevational view of a first embodiment of a Christmas star light device of the present invention being shown in an assembled condition.
Figure 2:
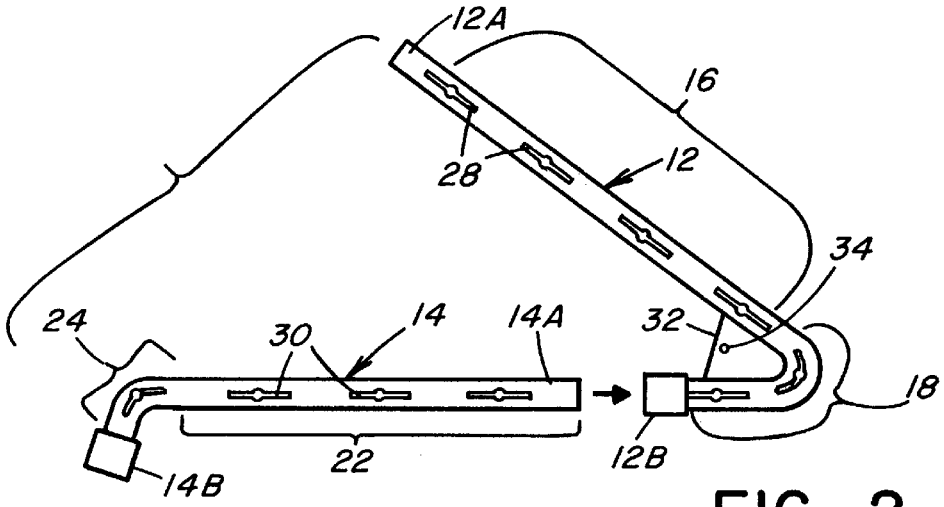
FIG. 2 is a front elevational view of a first tubular member of a set thereof and a second tubular member of a set thereof making up the device of FIG. 1 showing the first and second tubular members in a disassembled condition.
Figure 3:
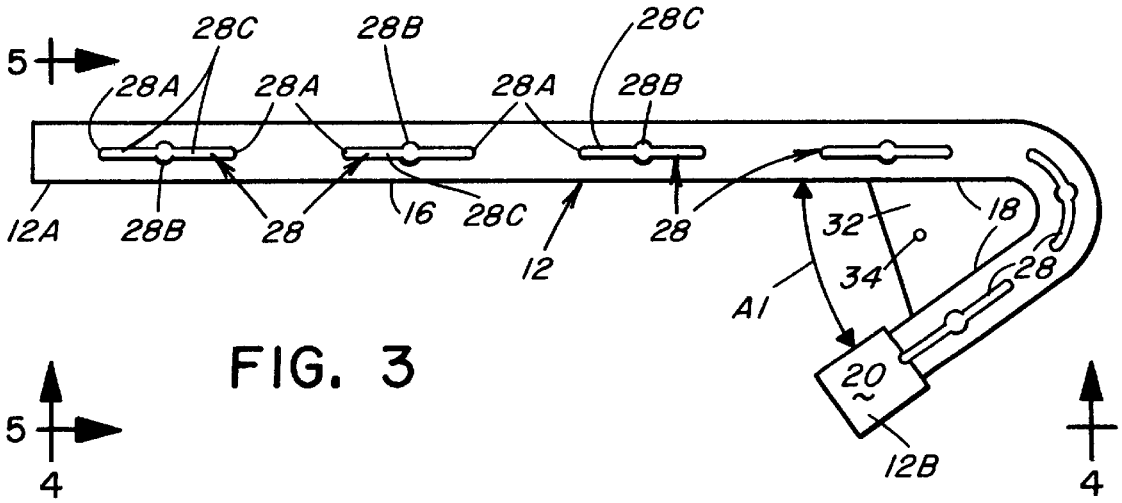
FIG. 3 is an enlarged front elevational view of the first tubular member shown in FIG. 2.
Figure 4:
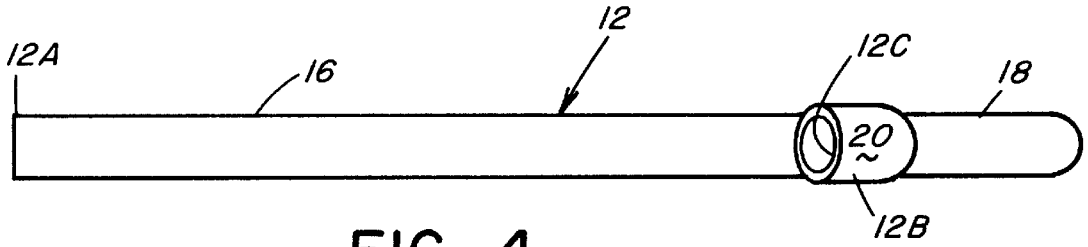
FIG. 4 is an end elevational view of the first tubular member as seen along line 4—4 of FIG. 3.
Figure 5:
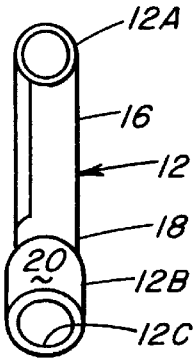
FIG. 5 is a side elevational view of the first tubular member as seen along 5—5 of FIG. 3.
Figure 6:
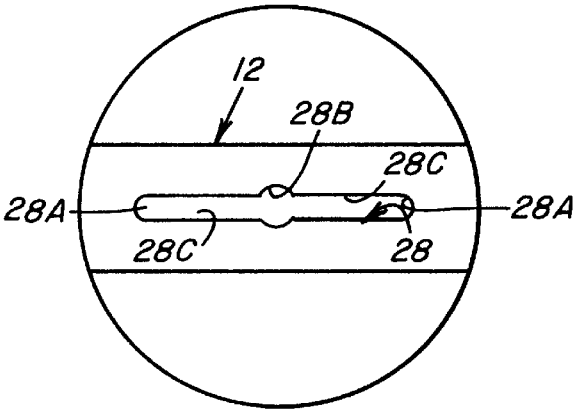
FIG. 6 is an enlarged detailed view of one of the slots shown in the first tubular member in FIGS. 2 and 3.
Figure 7:
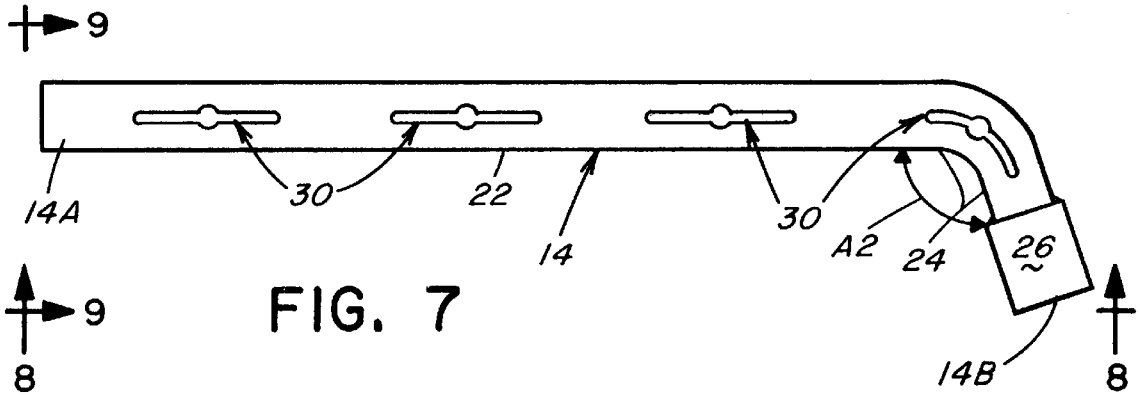
FIG. 7 is an enlarged front elevational view of the second tubular member shown in FIG. 2.
Figure 8:
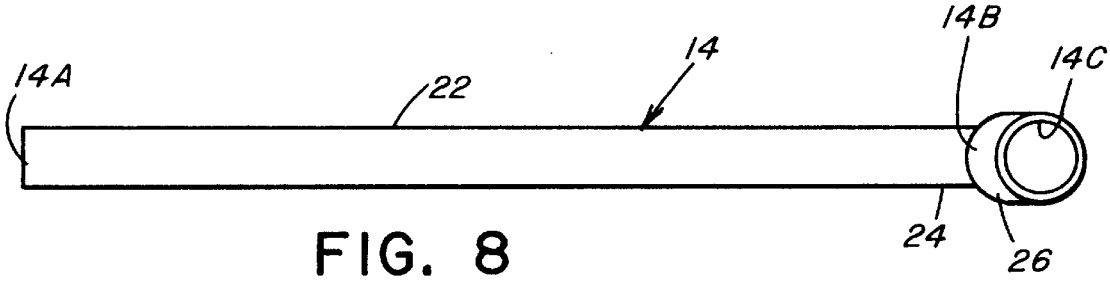
FIG. 8 is an end elevational view of the second tubular member as seen along line 8—8 of FIG. 7.
Figure 9:
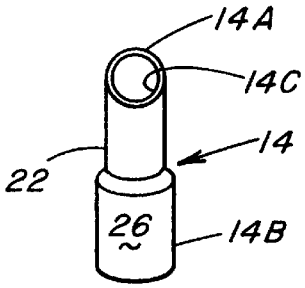
FIG. 9 is a side elevational view of the second tubular member as seen along line 9—9 of FIG. 7.
Figure 10:
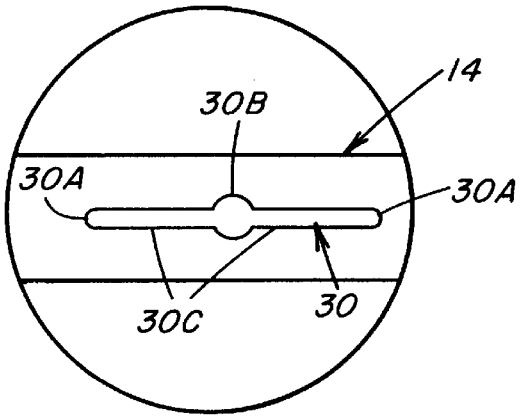
FIG. 10 is an enlarged detailed view of one of the slots shown in the second tubular member in FIGS. 2 and 7.

Referring to the drawings and particularly to FIG. 1, there is illustrated in an assembled condition a first embodiment of a Christmas star light device, generally designated 10, of the present invention. The Christmas star light device 10 basically includes a set of first elongated members 12 and a set of second elongated members 14. By way of example, there preferably are five of the first elongated members 12 and five of the second elongated members 14 that make up the ornamental star shape of the device 10, though other suitable numbers of the first and second tubular members 12, 14 and other desired ornamental shapes are possible. Each of the first and second elongated members 12, 14 is comprised of a substantially rigid but lightweight material, such as a suitable plastic, and can be manufactured using conventional fabrication techniques.

Referring now to FIGS. 1 to 5, the first elongated members 12 are substantially identical to one another with each having a tubular configuration and a substantially circular cross-sectional shape. Each first elongated member 12 includes a pair of opposite ends 12A, 12B, a straight portion 16 and an angled portion 18 together defining a hollow interior 12C extending through the first elongated member 12 between and open at the opposite ends 12A, 12B thereof. A first of the opposite ends 12A has a first diameter size D1. A second of the opposite ends 12B has a second diameter size D2 which is slightly greater than the first diameter size D1 of the first end 12A. As an example, the diameter size D1 can be about one inch and the diameter size D2 can be about 1 ¼ inches. The straight portion 16 terminates at the first end 12A of the first elongated member 12. The angled portion 18 merges from the straight portion 16 and terminates at the second end 12B of the first elongated member 12. As an example, each of the straight and angled portions 16, 18 and opposite ends 12A, 12B of the first elongated member 12 has a thickness of about ⅛ inch. The straight portion 16 has an axial length substantially greater than an axial length of the angled portion 18. The straight and angled portions 16, 18 of the first elongated member 12 have the same first diameter size D1 as the first end 12A thereof and are substantially uniform in diameter size throughout their lengths. The second end 12B of the first elongated member 12 having the second, larger diameter size D2 forms an annular collar 20 at the termination of the angled portion 18 of the first elongated member 12. The angled portion 18 defines a first angle A1 of a predetermined number of degrees. Preferably, the first angle A1 is an acute angle, such as of about 36 degrees.

Referring now to FIGS. 1, 2 and 7 to 9, the second elongated members 14 are substantially identical to one another with each having a substantially tubular configuration and a substantially circular cross-sectional shape. Each second elongated member 14 includes a pair of opposite ends 14A, 14B, a straight portion 22 and an angled portion 24 together defining a hollow interior 14C extending through the second elongated member 14 between and open at the opposite ends 14A, 14B thereof. A first of the opposite ends 14A has the first diameter size D1. A second of the opposite ends 14B has the second diameter size D2 which, as mentioned above, is slightly greater than the first diameter size D1 of the first end 14A. The straight portion 22 terminates at the first end 14A of the second elongated member 14. The angled portion 24 merges from the straight portion 22 and terminates at the second end 14B of the second elongated member 14. As an example, the second elongated member 14 has the same thickness and diameter sizes as the first elongated member 12. The straight portion 20 has an axial length substantially greater than an axial length of the angled portion 22. However, the respective axial lengths of the straight and angled portions 20, 22 of the second elongated member 14 are somewhat shorter than the respective axial lengths of the straight and angled portions 16, 18 of the first elongated member 12. The straight and angled portions 20, 22 of the second elongated member 14 have the same first diameter size D1 as the first end 14A thereof and are substantially uniform in diameter size throughout their lengths. The second end 14B of the second elongated member 14 having the second, larger diameter size D2 forms an annular collar 26 at the termination of the angled portion 22 of the second elongated member 14. The angled portion 22 defines a second angle A2 of a predetermined number of degrees. Preferably, the second angle A2 is an obtuse angle, such as of about 108 degrees.

Referring to FIGS. 1 to 3, 6, 7 and 10, each of the first and second elongated members 12, 14 has pluralities of slots 28, 30 defined therein being open to the hollow interiors 12C, 14C of the first and second tubular members 12, 14. The slots 28, 30 of the respective pluralities thereof are spaced apart from and aligned with one another along the axial lengths of the straight and angled portions 16, 18 and 22, 24 of the respective first and second elongated members 12, 14 between the opposite ends 12A, 12B and 14A, 24B thereof. Each slot 28, 30 has opposite ends 28A and 30A, a central eyelet 28B, 30B and opposite elongated portions 28C, 30C. The elongated portions 28C, 30C flank the central eyelet 28B, 30B and extend from opposite sides of the central eyelet 28B, 30B to the opposite ends 28A, 30A. The central eyelet 28B, 30B has a substantially circular shape and each elongated portion 28C, 30C has a substantially elongated shape with a rounded end at one of the opposite ends 28A, 30A. By way of example, the central eyelet 28B, 30B can have a diameter of about 21/64 inch and each elongated portion 28C, 30C can have a length of about 1 inch and a width of about 5/32 inch. Each slot 28, 30 is substantially uniform along the elongated portions 28C, 30C, but has the greater width at the central eyelet 28B, 30B. The slots 28 are six in number on each first elongated member 12, though any other suitable number is possible. The slots 30 are four in number on each second elongated member 14, though any other suitable number is possible.

Referring now to FIGS. 1 to 12, the first end 14A of each second elongated member 14 inserts into the second end 12B of a first elongated member 12 for releasably interfitting therewith so as to provide a releasable male/female type of coupling therebetween. Also, the first end 12A of each first elongated member 12 inserts into the second end 14B of a second elongated member 14 for releasably interfitting therewith so as to provide a releasable male/female type of coupling therebetween. Thus, as shown in FIG. 1, all of the first and second tubular members 12, 14 fit together in like fashion and thereby form a star configuration without any of the first and second tubular members 12, 14 crossing one another.

The device 10 also includes means for mounting the device 10 at least at the first elongated members 12 thereof to an external support structure (not shown), such as a building wall. The mounting means includes a plurality of braces 32. Each brace 32 is rigidly attached to the angled portion 18 of one of the first elongated members 12 and is disposed within the first angle A1 thereof so as to provide for mounting of the device 10 as well as for reinforcement of the angled portion 18. Each brace 32 has a substantially triangular shape when viewed from the front or rear and is substantially flat, though it may have any other suitable shape. Each brace 32 can have a thickness of about ¼ inch. Each brace 32 is disposed adjacent to the second end 12B of the first elongated member 12 and defines a hole 34 for receiving any suitable fastener (not shown) therethrough for attaching the first elongated member 12 to the external support structure. The hole 34 has a substantially circular shape, though may have any other suitable shape and is defined through the brace 32 interiorly of all edges 32A of the brace 32 but closest to an unattached one of the edges 34A. The hole 34 can have a diameter of about ⅛ inch.

An electrical cord 36 is employed with the device 10. The electrical cord 36 has a plurality of light elements 38 attached thereto and a plug (not shown) at one end for insertion into an electrical socket (not shown) to thereby provide electrical power to illuminate the light elements 38. The electrical cord 36 and light elements 38 thereon are of any suitable conventional type. The electrical cord 36 has a length which allows the same to extend along the exterior of all of the first and second elongated members 12, 14 which comprise the device 10. The light elements 38 are spaced an equal distance from one another, though need not be so limited. Each light element 38 has a bulb portion 40 and a mounting portion 42. The bulb portion 40 has a substantially cylindrical shape, though it may have any other suitable shape. The bulb portion 40 has opposite ends 40A, 40B. The end 40A tapers to a point. The mounting portion 42 also has a substantially cylindrical shape, though it may have any other suitable shape. The mounting portion 42 is hollow and has opposite ends 42A, 42B. The end 40B of the bulb portion 40 is mounted to the end 42A of the mounting portion 42. The mounting portion 42 receives and is attached to a portion 36A of the electrical cord 36 through the end 42B. The mounting portion 42 also has an external flange 42C formed about the end 42A.

Figure 11:
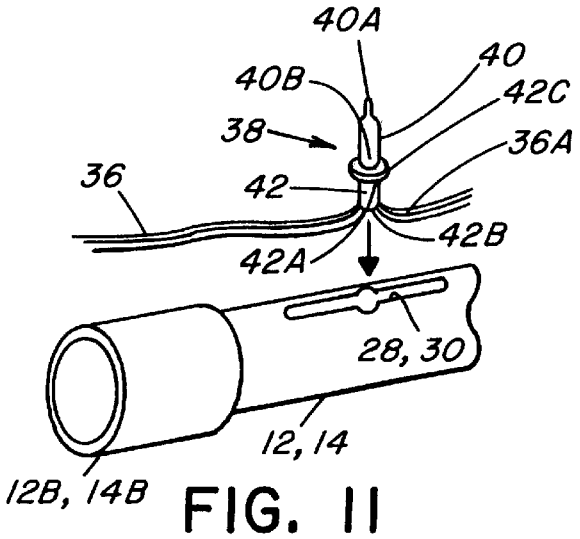
FIG. 11 is an enlarged fragmentary perspective end view of one of the tubular members of FIG. 2 showing a slot defined on the tubular member for receiving a light element on a portion of an electrical cord.
Figure 23:
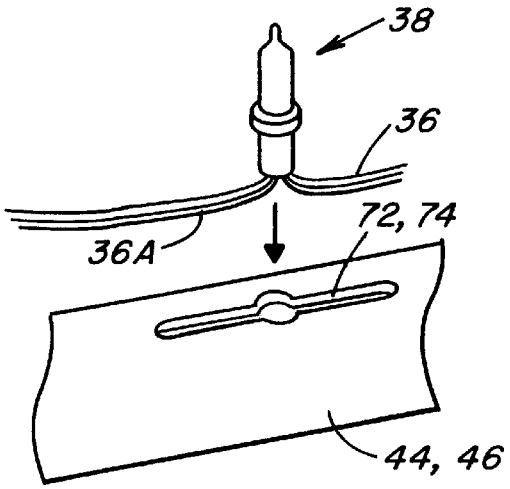
FIG. 23 is an enlarged fragmentary perspective end view of one of the channel members of FIGS. 14 and 18 showing a slot defined on the channel member for receiving a light element on a portion of an electrical cord.
Figure 12:
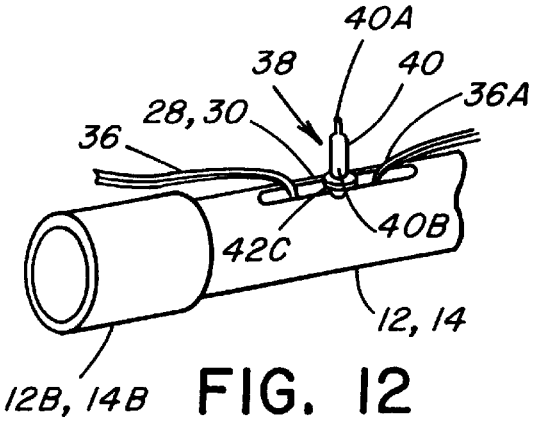
FIG. 12 is another view similar to that of FIG. 11 now showing the light element received in a central eyelet of the slot and the portion of the electrical cord received in opposite elongated flanking portions of the slot.
Figure 24:
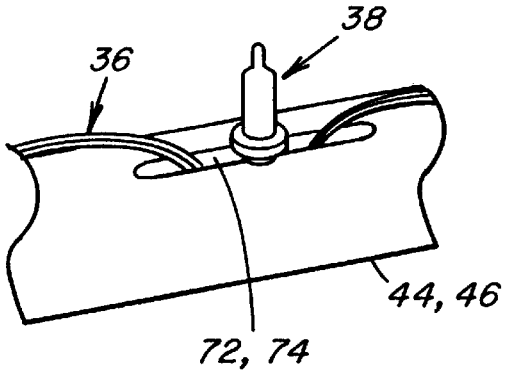
FIG. 24 is another view similar to that of FIG. 23 now showing the light element received in a central eyelet of the slot and the portion of the electrical cord received in opposite elongated flanking portions of the slot.

Referring to FIGS. 11 and 12, each slot 28, 30 of the first and second elongated members 12, 14 is adapted for receiving and mounting to the respective first and second elongated members 12, 14, one of the light elements 38 and one of the portions 36A of the electrical cord 36. The central eyelet 28B, 30B of each slot 28, 30 particularly receives the light element 38 of the electrical cord 36 and the opposite elongated portions 28C, 30C particularly receive the portion 36A of the electrical cord 36. Each light element 38 is disposed in a respective one of the slots 28, 30 such that the mounting portion 42 is disposed within the hollow interior 12C, 14C of one of the first and second elongated members 12, 14 and the bulb portion 40 extends outside of the one of the first and second elongated member 12, 14. The external flange 42C of the mounting portion 42 of each light element 38 keeps the bulb portion 40 from passing through the respective slot 28, 30. The slots 28, 30 are spaced an equal distance from one another, though need not be so limited, and match the spacing of the light elements 38 along the electrical cord 36. Thus, each first elongated member 12 has six light elements 38 mounted thereto and each second elongated member 14 has four light elements 38 mounted thereto. The slots 28, 30 on all ten of the first and second elongated members 12, 14 together are fifty in number and can receive fifty light elements 38.

Referring now to FIGS. 13 to 24, there is illustrated a second embodiment of the Christmas star light device 10 of the present invention. In the second embodiment, each of first and second elongated members 44, 46 of the device 10 has a substantially U-shaped cross-sectional channel configuration. The first and second channel-shaped elongated members 44, 46 are shaped to interfit with one another and are substantially identical to the first and second tubular-shaped elongated members 12, 14 but for their different cross-sectional configurations and means for interfitting with one another.

Each of the first elongated members 44 has a pair of opposite ends 44A, 44B, a straight portion 48 and an angled portion 50 together defining a hollow interior 44C extending through the first elongated member 44 between and open along a rear side 44D thereof between the opposite ends 44A, 44B thereof. A first of the opposite ends 44A and the straight and angled portions 48, 50 of the first elongated member 44 have a first cross-sectional size. As an example, the first cross-sectional size can be a thickness of about ⅛ inch, a height of about ⅞ inch and a width which increases slightly going from a front wall 44E to the rear side 44D of the first elongated member 44 from about 15⁄16 inch to about 1 inch. A second of the opposite ends 44B has a second cross-sectional size which is slightly greater than the first cross-sectional size of the first end 44A and straight and angled portions 48, 50 of the first elongated member 44. For example, the second cross-sectional size can be a thickness of ⅛ inch, a height of 1 inch and a width of 1 3⁄16 inch. Each of the first elongated members 44 also has a first detent means 52 defined on the first end 44A thereof and a second detent means 54 defined on the second end 44B thereof. The second detent means 54 is complementary in configuration to the first detent means 52.

Each of the second elongated members 46 has a pair of opposite ends 46A, 46B a straight portion 56 and an angled portion 58 together defining a hollow interior 46C extending through the second elongated member 46 between and open along a rear side 46D thereof between the opposite ends 46A, 46B thereof. A first of the opposite ends 46A and the straight and angled portions 56, 58 of the second elongated member 46 have the first cross-sectional size. A second of the opposite ends 46B has the second cross-sectional size which is slightly greater than the first cross-sectional size of the first end 46A and straight and angled portions 56, 58 of the second elongated member 46. Each of the second elongated members 46 also has the first detent means 52 defined on the first end 46A thereof and the second detent means 54 defined on the second end 46B thereof. As an example, the second elongated member 46 has the same thickness, height and width sizes as the first elongated member 44.

Figure 22:
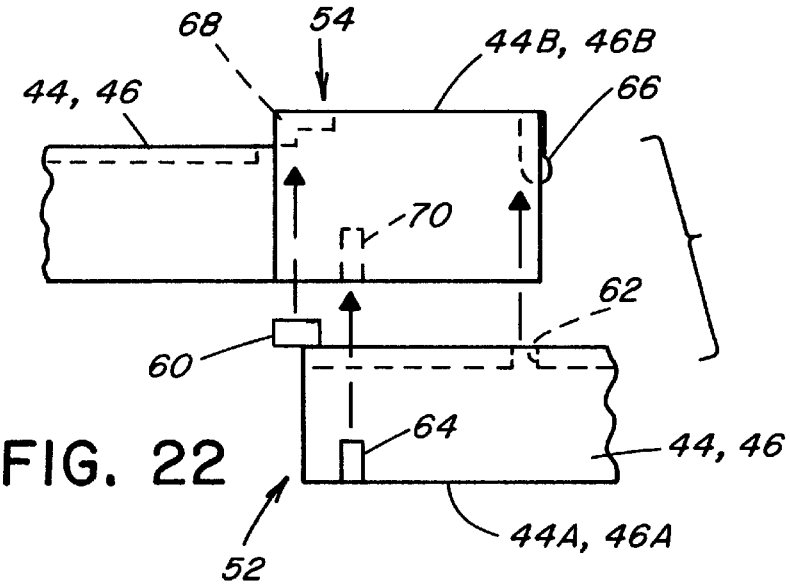
FIG. 22 is an enlarged longitudinal sectional view of a first end of one of the first channel members inserted in a second end of one of the second channel members such that their respective first and second detent means are releasably snap fitted together.

More particularly, referring to FIG. 22, the first detent means 52 defined on the first end 44A, 46A of each of the first and second elongated members 44, 46 adjacent to the respective straight portions 48, 56 thereof includes an end tab 60, a transverse slot 62 and a pair of guide tracks 64. The end tab 60 is formed on and extending outwardly above and axially beyond front wall 44E, 46E of each the first and second elongated members 44, 46 at the first end 44A, 46A thereof. The transverse notch 62 is defined in the front wall 44E, 46E of each of the first and second elongated members 44, 46 at the first end 44A, 46A thereof and is spaced axially from the end tab 60. The pair of guide tracks 64 are spaced between the end tab 60 and transverse notch 62, located adjacent to the rear side 44C, 46C, and formed on the exterior of opposite side walls 44F of each of the first and second elongated members 44, 46 at the first ends 44A, 44B thereof. The end tabs 60, transverse notches 62 and guide tracks 64 can have substantially rectangular configurations.

The second detent means 54 defined on the second end 44B, 46B of each of the first and second elongated members 44, 46 adjacent to the respective angled portions 50, 58 thereof includes an end latch 66, an aperture 68 and a pair of guide grooves 70. The end latch 66 is formed on and extends inwardly below and axially beyond the front wall 44E, 46E of each the first and second elongated members 44, 46 at the first end 44A, 46A thereof. The aperture 68 is defined in the front wall 44E, 46E of each of the first and second elongated members 44, 46 at the first end 44A, 46A thereof and is spaced axially from the end latch 66. The pair of guide grooves 70 are spaced between the end latch 66 and aperture 68, located adjacent to the rear side 44C, 46C, and formed on the interior of opposite side walls 44F, 46F of each of the first and second elongated members 44, 46 at the first ends 44A, 44B thereof. The end latches 66, apertures 68 and guide grooves 70 can have substantially rectangular configurations. With a first end 44A of a given one of the first and second elongated members 44, 46 positioned below a second end 46B of a given another one of the first and second elongated members 44, 46 and their respective pairs of guide tracks 62 and guide grooves 70 aligned with each other, the respective first and second ends 44A, 46A can be moved toward one another such that the first end 44A of the one of the members 44, 46 and the guide tracks 62 enters the hollow interior 46C and guide grooves 70 of the second end 46B of the other of the first and second members 44, 46. With the exertion of a moderate amount of manually-applied pressure forcing the first and second ends 44A, 46B toward one another and into a nested relationship, the end tab 60 on the first end 44A will enter the aperture 66 in the second end 46B and make a snap interfitting type of engagement with the adjacent edge of the front wall 46E and the latch 66 on the second end 46B will enter the transverse slot 64 in the first end 44A and make an snap interfitting type of engagement with the adjacent edge of the front wall 44A. This interfitting of the first and second channel-shaped elongated members 44, 46 accomplishes substantially the same as does the interfitting of the first and second tubularshaped elongated members 12, 14. By slightly forcable fulcuming of the second elongated member 46 relative to the first elongated member 44 about the location of the latch 66 the snap type of interfitting engagement of the latch 66 on the second end 46B with the edge of the front wall 44E of the first member 44 adjacent to the transverse slot 64 can be broken so as to allow release of the locking interfitting of the first and second detent means 52, 54 with one another.

Figure 13:
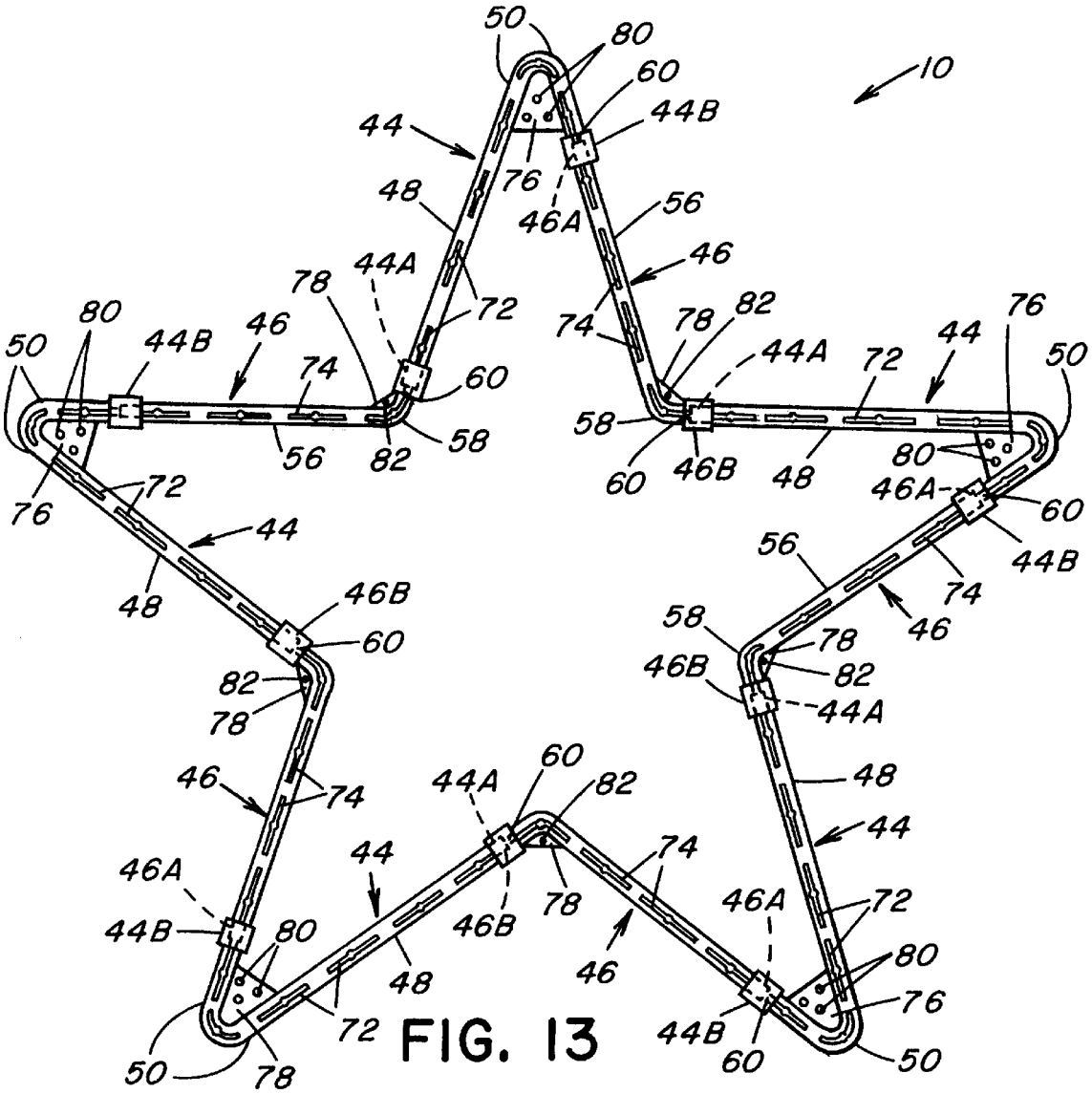
FIG. 13 is a front elevational view of a second embodiment of the Christmas star light device of the present invention being shown in an assembled condition.
Figure 15:
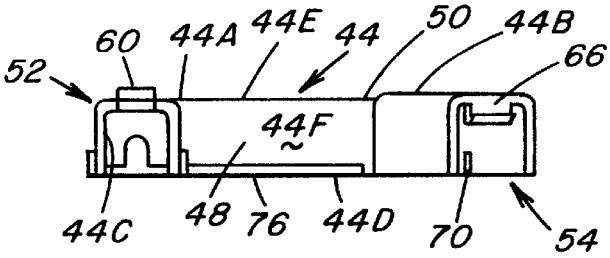
FIG. 15 is an end elevational view of the first channel member as seen along line 15—15 of FIG. 14.
Figure 19:
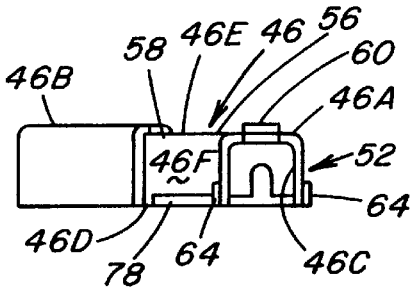
FIG. 19 is an end elevational view of the second channel member as seen along line 19—19 of FIG. 18.
Figures 14, 16, 17:
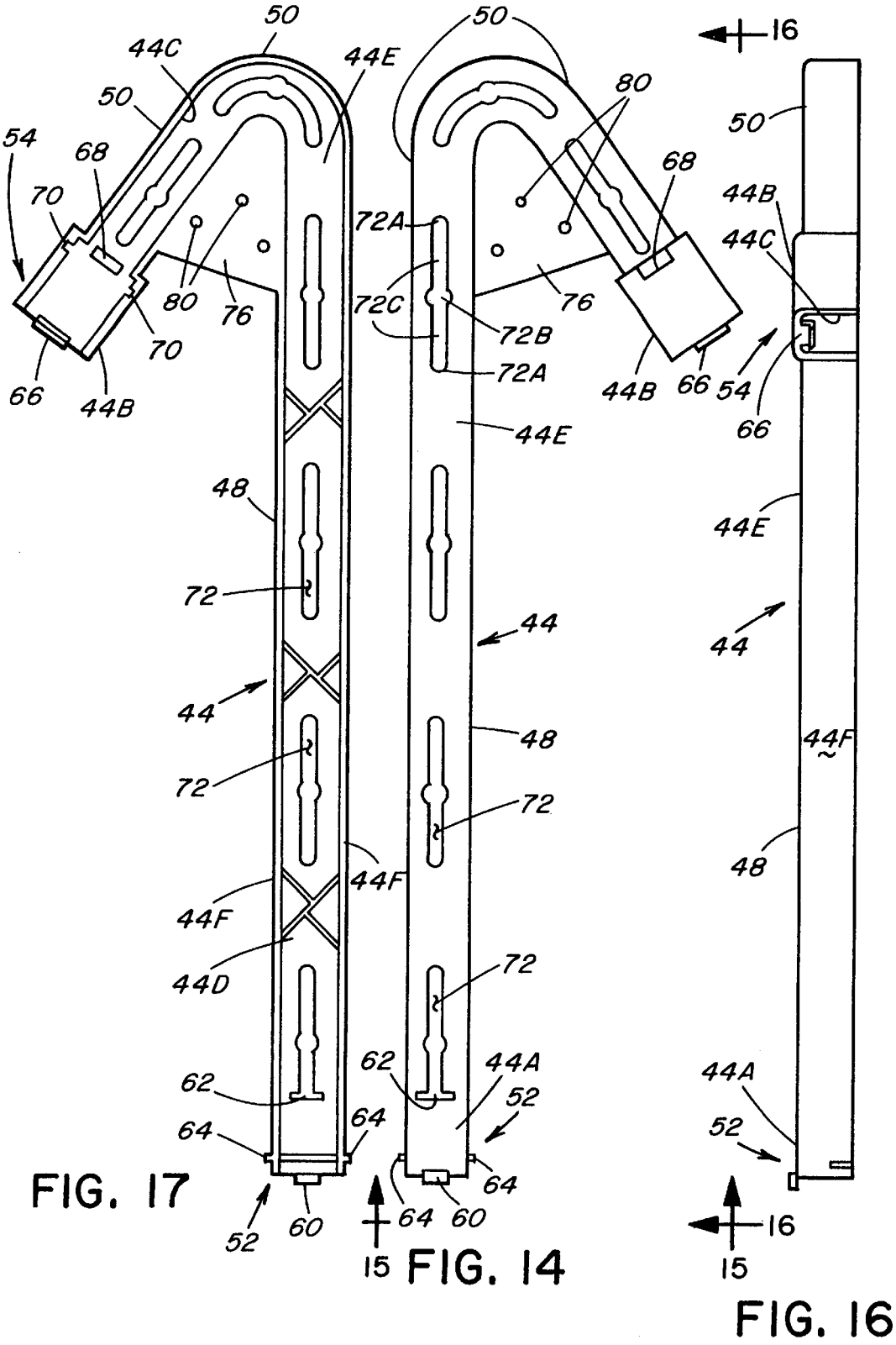
FIG. 14 is an enlarged front elevational view of a first channel member of the device of FIG. 13.
FIG. 16 is a side elevational view of the first channel member as seen along line 16—16 of FIG. 14.
FIG. 17 is a rear elevational view of the first channel member of the device of FIG. 13.
Figures 18, 20, 21:
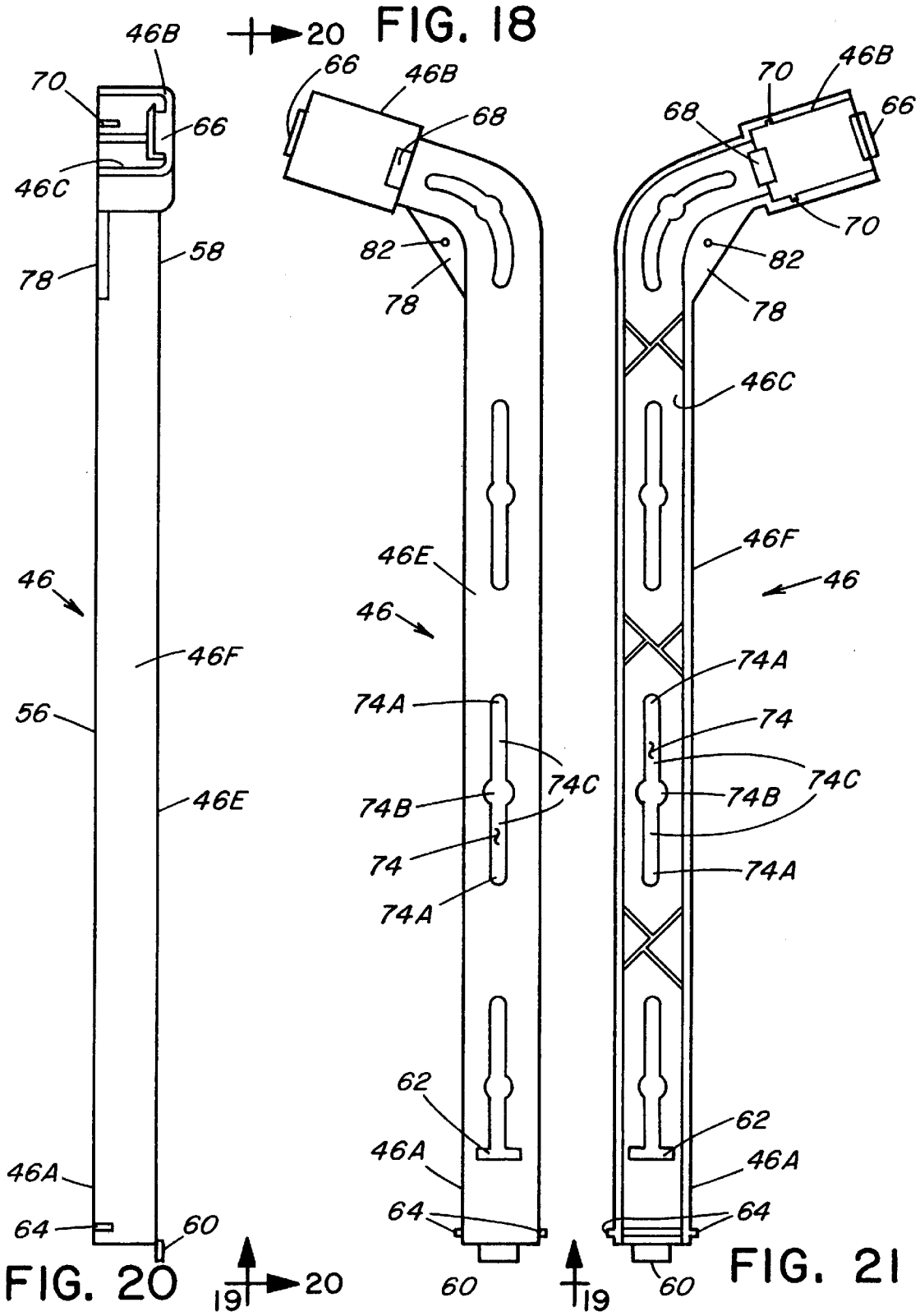
FIG. 18 is an enlarged front elevational view of a second channel member of the device of FIG. 13.
FIG. 20 is a side elevational view of the second channel member as seen along line 20—20 of FIG. 18.
FIG. 21 is a rear elevational view of the second channel member of the device of FIG. 13.

To recapitulate, the straight and angled portions 48, 50 and 56, 58 and the first end 44A, 46A of each of the first and second elongated members 44, 46 have the first cross-sectional size and the second end 44B, 46B of each of the first and second elongated members 44, 46 have the second cross-sectional size slightly greater than the first cross-sectional size. Accordingly, the first end 46A of each of the second elongated members 46 inserts into the second end 44B of one of the first elongated members 44 for releasably interfitting therewith and for releasably snap interfitting the first detent means 52 on the first end 46B of each of the second elongated members 46 with the second detent means 54 on the second end 44B of one of the first elongated members 44. Also, the first end 44A of each of the first elongated members 44 inserts into the second end 46B of one of the second elongated members 4 for releasably interfitting therewith and for releasably snap interfitting the first detent means 52 on the first end 44A of each of the first elongated members 44 with the second detent means 54 on the second end 46B of one of the second elongated members 46. In such manner, as seen in FIG. 13, all of the first and second elongated members 44, 46 fit together in like fashion and form a star without any of the first and second elongated members 44, 46 crossing one another.

Also, each of the first and second elongated members 44, 46 has pluralities of slots 72, 74 defined therein being open to the hollow interiors 44C, 46C of the first and second elongated members 44, 46. The slots 72, 74 in the first and second channel-shaped elongated members 44, 46 are spaced apart and aligned with one another and each has opposite ends 72A and 74A, a central eyelet 72B, 74B and opposite elongated portions 72C, 74C the same as as the slots 28, 30 in the first and second tubular-shaped elongated members 12, 14. As can be readily seen in FIGS. 23 and 24, the slots 72, 74 in the first and second channel-shaped elongated members 44, 46 receive the light elements 38 and portions 36A of the electrical cord 36 in the same manner as described above with reference to the slots 28, 30 of the first and second tubular-shaped elongated members 12, 14 as shown in FIGS. 11 and 12.

The second embodiment of the device 10 also includes means for mounting the device 10 at both the first and second elongated members 44, 46 thereof to an external support structure. The mounting means includes pluralities of braces 76, 78 having respective holes 80, 82. The braces 76, 78 are rigidly attached to the angled portions 50, 58 of the first and second elongated members 44, 46 and are disposed within the first and second angles Al, A2 thereof so as to provide for mounting of the device 10 as well as for reinforcement of the angled portions 50, 58.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A Christmas star light device, comprising:

(a) a set of first elongated members each including (i) a pair of opposite ends, (ii) means defined on said first elongated member between said opposite ends thereof for receiving and mounting light elements on said first elongated member; and (iii) a straight portion terminating at a first of said opposite ends of said first elongated member having a first cross-sectional size, (iv) an angled portion defining a first angle and merging from said straight portion and terminating at a second of said opposite end of said first elongated member having a second cross-sectional size greater than said first cross-sectional size; and (b) a set of second elongated members each including (i) a pair of opposite ends, (ii) means defined on said second elongated member between said opposite ends thereof for receiving and mounting light elements on said second elongated member, (iii) a straight portion terminating at a first of said opposite ends of said second elongated member having a first cross-sectional size, (iv) an angled portion defining a second angle and merging from said straight portion and terminating at a second of said opposite ends of said second elongated member having a second cross-sectional size greater than said first cross-sectional size such that said first end of each of said second elongated members is insertable into said second end of one of said first elongated members for releasably interfitting therewith and said first end of each of said first elongated members is insertable into said second end of one of said second elongated members for releasably interfitting therewith whereby all of said first and second elongated members fit together in like fashion and form a star without any of said first and second elongated members crossing one another.

2. The device of claim 1 wherein said straight and angled portions of each of said first and second elongated members has said first cross-sectional size of said first end of each of said first and second elongated members.

3. The device of claim 1 wherein each of said first and second elongated members has a tubular configuration.

4. The device of claim 1 wherein each of said first and second elongated members has a cross-sectionally U-shaped channel configuration.

5. The device of claim 1 wherein said first angle of said angled portion of each of said first elongated members is an acute angle.

6. The device of claim 1 wherein said second angle of said angled portion of each of said second elongated members is an obtuse angle.

7. The device of claim 1 wherein said means for receiving light elements is a plurality of slots being longitudinally spaced apart from one another along each of said first and second elongated members.

8. The device of claim 7 wherein each of said slots has a central eyelet and opposite elongated portions flanking said central eyelet, said central eyelet for receiving a light element on a portion of an electrical cord and said opposite elongated portions for receiving the portion of the cord.

9. A Christmas star light device, comprising:

(a) a set of first tubular members each including (i) a pair of opposite ends, (ii) a plurality of slots defined on and spaced apart from one another along said first tubular member between said opposite ends thereof for receiving and mounting light elements on said first tubular member, (iii) a straight portion terminating at a first of said opposite ends of said first tubular member, (iv) an angled portion defining a first angle and merging from said straight portion and terminating at a second of said opposite ends of said first tubular member, said straight and angled portions and said first end of said first tubular member having a first diameter size, said second end of said first tubular member having a second diameter size greater than said first diameter size; and (b) a set of second tubular members each including (i) a pair of opposite ends, (ii) a plurality of slots defined on and spaced apart from one another along said second tubular member between said opposite ends thereof for receiving and mounting light elements on said second tubular member, (iii) a straight portion terminating at a first of said opposite ends of said second tubular member, and (iv) an angled portion defining a second angle and merging from said straight portion and terminating at a second of said opposite ends of said second tubular member, said straight and angled portions of said second tubular member and said first end of said second tubular member having said first diameter size and said second end of said second tubular member having said second diameter size such that said first end of each of said second tubular members is insertable into said second end of one of said first tubular members for releasably interfitting therewith and said first end of each of said first tubular members is insertable into said second end of one of said second tubular members for releasably interfitting therewith whereby all of said first and second tubular members fit together in like fashion and form a star without any of said first and second tubular members crossing one another.

10. The device of claim 9 wherein said first angle of said angled portion of each of said first tubular members is an acute angle.

11. The device of claim 9 wherein said second angle of said angled portion of each of said second tubular members is an obtuse angle.

12. The device of claim 9 wherein each of said slots of each said first and second tubular member has a central eyelet and opposite elongated portions flanking said central eyelet, said central eyelet for receiving a light element on a portion of an electrical cord and said opposite elongated portions for receiving the portion of the cord.

13. The device of claim 9 further comprising:

means for mounting said-first tubular members to an external support structure.

14. The device of claim 13 wherein said mounting means includes a plurality of braces each attached to said angled portion of one of said first-tubular members and disposed within said first angle thereof so as to provide reinforcement of said angled portion, said brace defining a hole for receiving a fastener therethrough for mounting said first tubular member to the external support structure.

15. A Christmas star light device, comprising:

(a) a set of cross-sectionally U-shaped first channel members each including (i) a pair of opposite ends, (ii) a plurality of slots defined on, and spaced apart from and aligned with one another along, said first channel member between said opposite ends thereof for receiving and mounting light elements on said first channel member, (iii) a straight portion terminating at a first of said opposite ends of said first channel member, (iv) an angled portion defining a first angle and merging from said straight portion and terminating at a second of said opposite ends of said first channel member, said straight and angled portions and said first end of said first channel member having a first cross-sectional size, said second end of said first channel member having a second cross-sectional size greater than said first cross-sectional size;

(v) first detent means defined on said first end of said first channel member, and (vi) second detent means defined on said second end of said first channel member being complementary to said first detent means; and (b) a set of cross-sectionally U-shaped second channel members each including (i) a pair of opposite ends, (ii) a plurality of slots defined on, and spaced apart from and aligned with one another along, said second channel member between said opposite ends thereof for receiving and mounting light elements on said second channel member, (iii) a straight portion terminating at a first of said opposite ends of said second channel member, said first detent means also defined on said first end of said second channel member, (iv) an angled portion defining a second angle and merging from said straight portion and terminating at a second of said opposite ends of said second channel member, said second detent means also defined on said second end of said second channel member, said straight and angled portions and said first end of said second channel member having said first cross-sectional size and said second end of said second channel member having said second cross-sectional size such that said first end of each of said second channel members is insertable into said second end of one of said first channel members for releasably interfitting therewith and for releasably snap fitting said first detent means on said first end of each of said second channel members with said second detent means on said second end of one of said first channel members and said first end of each of said first channel members is insertable into said second end of one of said second channel members for releasably interfitting therewith and for releasably snap fitting said first detent means on said first end of each of said first channel member with said second detent means on said second end of one of said second channel members whereby all of said first and second channel members fit together in like fashion and form a star without any of said first and second channel members crossing one another.

16. The device of claim 15 wherein said first angle of said angled portion of each of said first channel members is an acute angle.

17. The device of claim 15 wherein said second angle of said angled portion of each of said second channel members is an obtuse angle.

18. The device of claim 15 wherein each of said slots of each said first and second channel members has a central eyelet and opposite elongated portions flanking said central eyelet, said central eyelet for receiving a light element on a portion of an electrical cord and said opposite elongated portions for receiving the portion of the cord.

19. The device of claim 15 further comprising:

means for mounting said first channel members to an external support structure.

20. The device of claim 19 wherein said mounting means includes a plurality of braces each attached to said angled portion of one of said first channel members and disposed within said first angle thereof so as to provide reinforcement of said angled portion, said brace defining a hole for receiving a fastener therethrough for mounting said first channel member to the external support structure.

* * * * *